US005735357A

United States Patent [19]

Palm

[11] Patent Number: 5,735,357

[45] Date of Patent: Apr. 7, 1998

[54] APPARATUS FOR AND METHOD OF DIRECTIONAL DRILLING

[75] Inventor: Carl R. Palm, Kemah, Tex.

[73] Assignee: Radius Metier, Inc., Houston, Tex.

[21] Appl. No.: 644,428

[22] Filed: May 10, 1996

[51] Int. Cl.[6] ..... E21B 7/08

[52] U.S. Cl. ..... 175/61; 175/74

[58] Field of Search ..... 175/61, 107, 62, 175/74, 325.2, 26, 38; 166/50, 117.5

[56] References Cited

U.S. PATENT DOCUMENTS

| | | | |
|---|---|---|---|
| 3,799,277 | 3/1974 | Kellner | 175/94 |
| 4,076,084 | 2/1978 | Tighe | 175/73 |
| 4,811,798 | 3/1989 | Falgout, Sr. et al. | 175/73 |
| 5,232,058 | 8/1993 | Morin et al. | 175/73 |
| 5,259,467 | 11/1993 | Schoeffler | 175/38 |
| 5,311,925 | 5/1994 | Eddison et al. | 175/61 |
| 5,339,913 | 8/1994 | Rives | 175/73 |
| 5,450,914 | 9/1995 | Coram | 175/73 |
| 5,503,235 | 4/1996 | Falgout, Sr. | 175/61 |

*Primary Examiner*—Frank Tsay
*Attorney, Agent, or Firm*—Vaden, Eickenroht & Thompson, L.L.P.

[57] ABSTRACT

A bottom hole assembly for use with coil tubing for drilling, comprising a mud motor having a housing that is bent at its lower end, an output shaft extending through the bent housing, a drill bit connected to the output shaft to be rotated as drilling mud is pumped through the mud motor, a rotator having a torque tube that is connected to the housing of the mud motor to allow the rotator to rotate the housing of the mud motor to change the orientation of the bent section of the housing as required to drill in the desired direction, a steering tool having a housing connected to the housing of the rotator and a central mandrel that is connected to the torque tube of the rotator so that the sensors of the steering tool will be rotated by the rotator the same angular distance as the bent housing so that the orientation of the sensors in the steering tool and the bent housing is always the same.

The rotator rotates the steering tool and the mud motor an incremental distance by using mud pressure to move a piston to cause cam arms that are in engagement with an internal ratchet to rotate a torque tube connected to the mandrel of the steering tool and the housing of the motor an incremental distance. The torque tube is rotated the same incremental distance each time the pressure is reduced and increased in the rotator.

7 Claims, 5 Drawing Sheets

FIG. 1
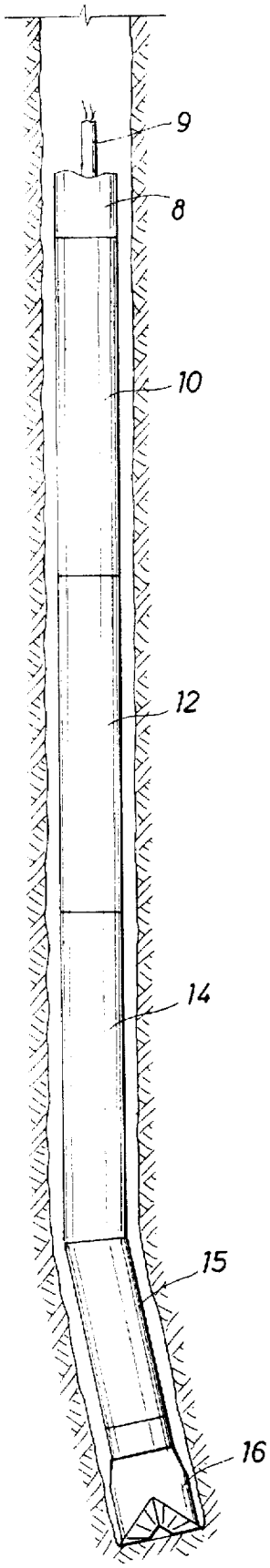
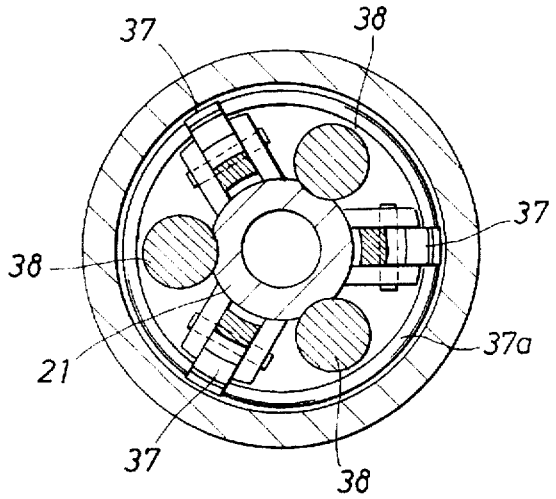
FIG. 8
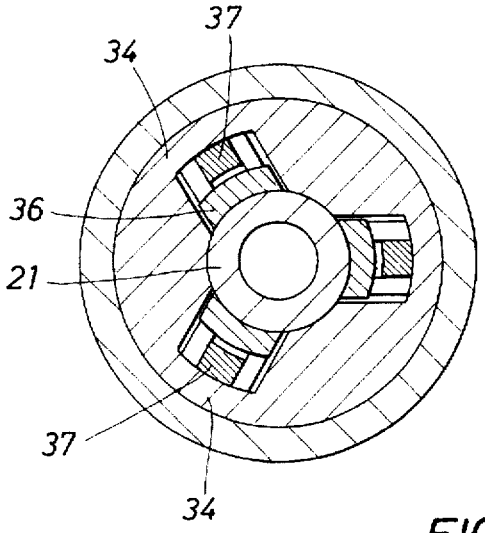
FIG. 9

APPARATUS FOR AND METHOD OF DIRECTIONAL DRILLING

This invention relates to directional drilling generally. In one aspect, the invention relates to a rotator for connecting in a bottom hole assembly for rotating a drilling motor an incremental distance using the pressure of the drilling fluid. In yet another aspect, the invention relates to a bottom hole assembly of a mud motor with a bent housing connected to a drill bit, a steering tool, and a rotator between the mud motor and the steering tool that will rotate the mud motor to reposition the bent housing and the steering tool sensors simultaneously so that the orientation of the steering tool sensors and the bent housing is unchanged as the bent housing is repositioned.

The apparatus and method of this invention are particularly useful for use with coil tubing for drilling directionally controlled lateral drain holes. For example, in fractured reservoirs, such as the Austin chalk formation in Texas, a vertical well is drilled to the formation then a lateral drain hole is drilled following the drip angle of the formation in the hope of penetrating one or more fractured zones in which hydrocarbons are trapped. The lateral portion of the well bore is usually drilled using coiled tubing.

The bottom hole assembly (BHA) for kicking the well off vertical using coil tubing includes a drill bit attached to a mud motor for rotating the bit, and a steering tool. This assembly usually has a bent sub between the steering tool and the motor and the motor has a bent housing all of which being designed to build angle rapidly. When the desired angle is reached, this BHA is replaced by a "hold angle" assembly that is the same except the bent sub is removed. The steering tool can be either one that transmits information to the surface through an electrical cable or an MWD tool that transmits information to the surface using pressure pulses in the drilling mud. The steering tool may also include, and usually does include, a gamma ray counter.

One obvious problem with this arrangement is the inability to rotate the coiled tubing to adjust the position of the bent housing although the reactive torque on the coil tubing by the torque supplied to the bit by the mud motor will cause the BHA to rotate in the opposite direction varying amounts as the torque varies as the weight on the bit varies.

Therefore, it is an object and feature of this invention to provide a stepping motor or rotator that will rotate the mud motor and the bent housing an incremental distance by stopping or reducing the flow of drilling fluid and then increasing the pressure in the drilling fluid at the BHA.

It is a further object and advantage of this invention to provide a downhole assembly that includes a steering tool, a mud motor, and the rotator of this invention positioned between the steering tool and the mud motor that will rotate the steering tool sensors the same distance that the rotator rotates the mud motor so that the sensors will always remain oriented properly with the bent housing of the mud motor.

It is a further object and feature of this invention to provide a rotator that can provide sufficient torque to rotate both the sensors of the steering tool and the mud motor at the same time.

These and other objects, advantages, and features of this invention will be apparent to those skilled in the art from a consideration of the specification including the attached drawings and appended claims.

IN THE DRAWINGS

FIG. 1 is a view in elevation of a bottom hole assembly including steering tool 10 connected to coiled tubing 8 and electrical cable 9, rotator 12, and mud motor 14 having bent housing 15, the lower end of which is attached to bit 16. The bit is rotated relative to the housing of the mud motor by an output shaft (not shown) that extends through the bent housing and is connected to bit 16.

FIGS. 2A, 2B, and 2C are vertical sectional views of the rotator of this invention when no drilling mud or drilling fluid is being circulated through the tool.

FIGS. 3A and 3B are vertical sectional views through the portions of the rotator shown in FIGS. 2A and 2B after the pressure of the drilling fluid has increased sufficiently to cause the rotator to rotate the mandrel of the steering tool above the rotator and the housing of the mud motor below the rotator an incremental distance. This is also the condition of the upper portion of the rotator during drilling operations when the drilling mud is being circulated through central passageway 30 of the torque tube of the rotator to the mud motor and drilling bit below.

FIG. 8 is a sectional view taken along line 8—8 of FIG. 2A.

FIG. 9 is a sectional view taken along line 9—9 of FIG. 3A.

Basically the rotator rotates the steering tool and the mud motor an incremental distance by using mud pressure to move a piston to cause cam arms that are in engagement with an internal ratchet to rotate a torque tube connected to the mandrel of the steering tool and the housing of the motor an incremental distance. The torque tube is rotated the same incremental distance each time the pressure is reduced and increased in the rotator.

Figure 2A:
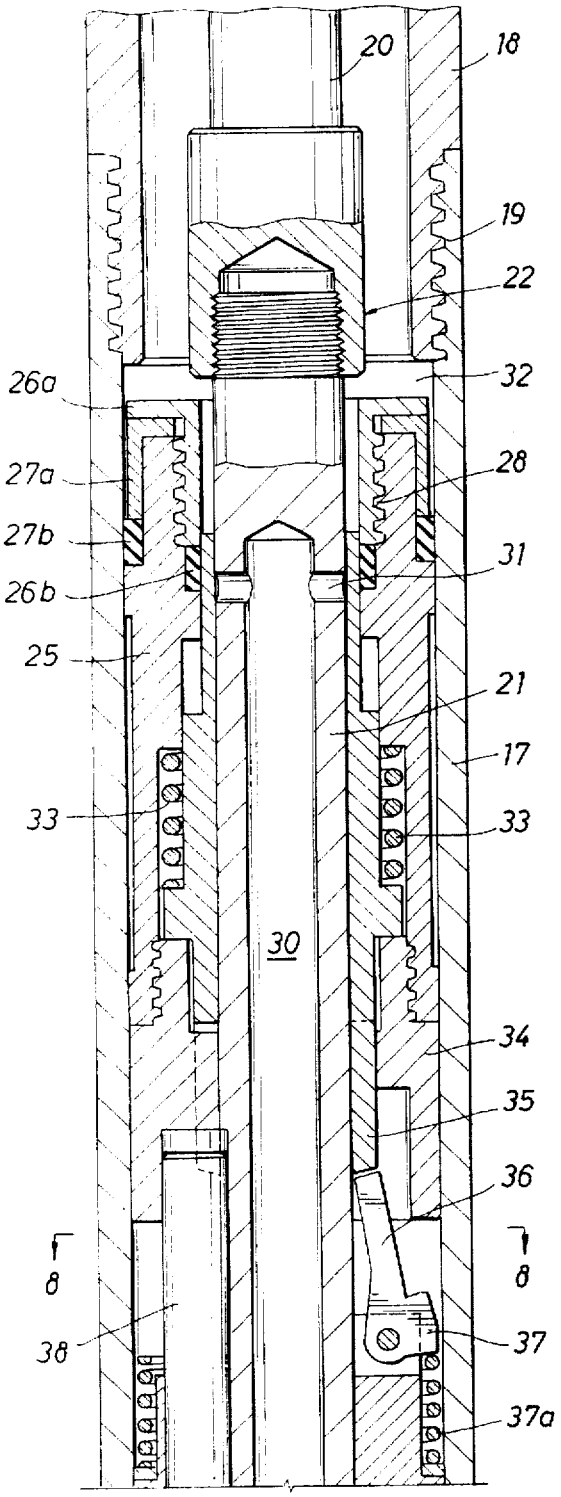
Figure 2B:
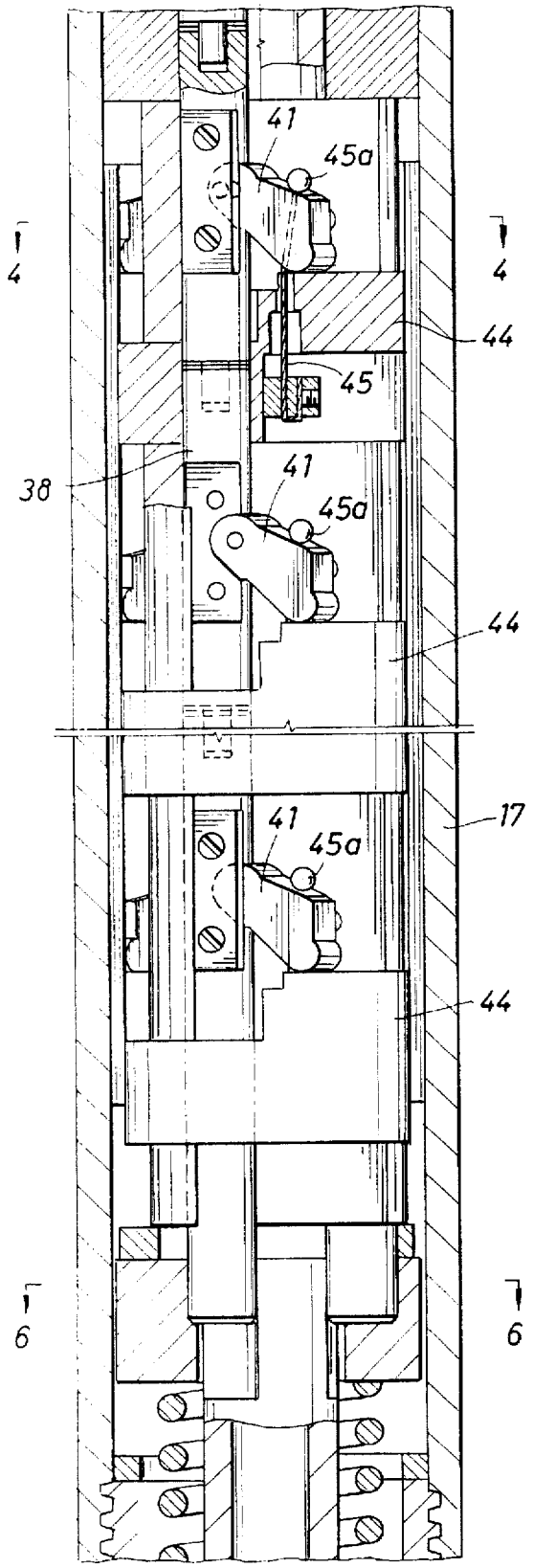
Figure 2C:
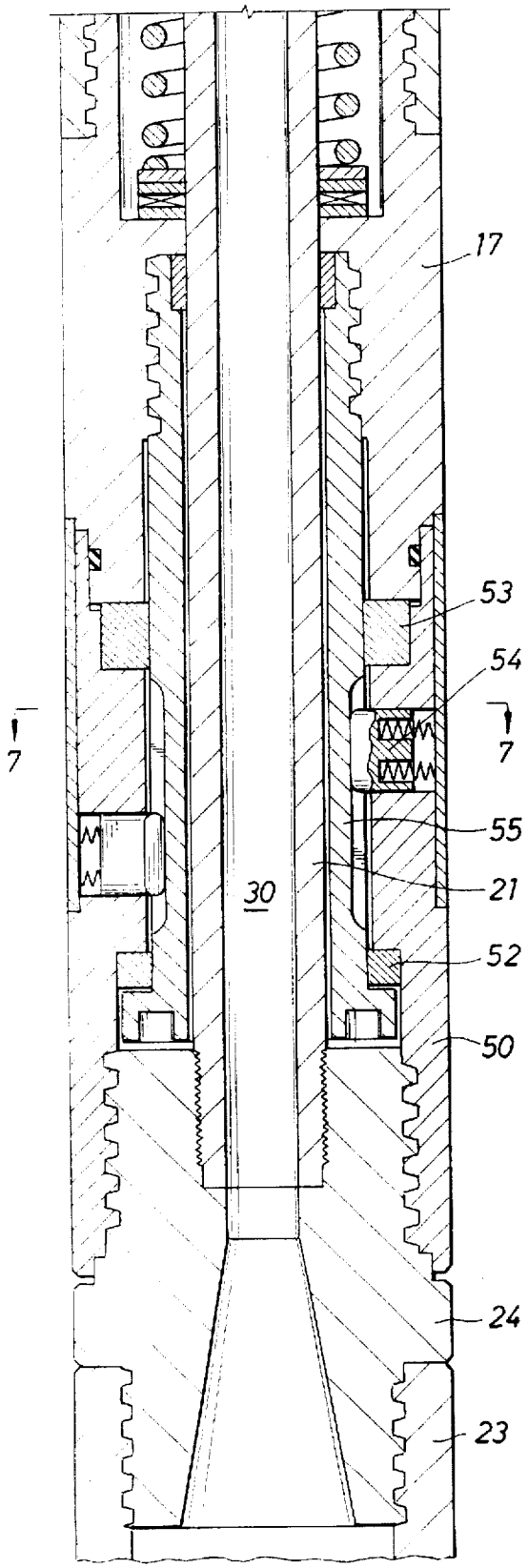

Referring now to the drawings, rotator housing 17 is attached to housing 18 of the steering tool by threads 19. Output shaft 20 of the steering tool is connected to the upper end of torque tube 21 of the rotator by threaded coupling 22. Torque tube 21 extends all the way through the rotator and is connected to mud motor housing 23 by double threaded pin adapter 24, as shown in FIG. 2C. One of the features of this invention is that the rotator rotates not only the mud motor but also mandrel 20 of the steering tool the same distance each time it is actuated so that the sensors in the steering tool will maintain the same orientation to the bent housing of the mud motor as the rotator repositions the bent housing of the mud motor.

Figure 3A:
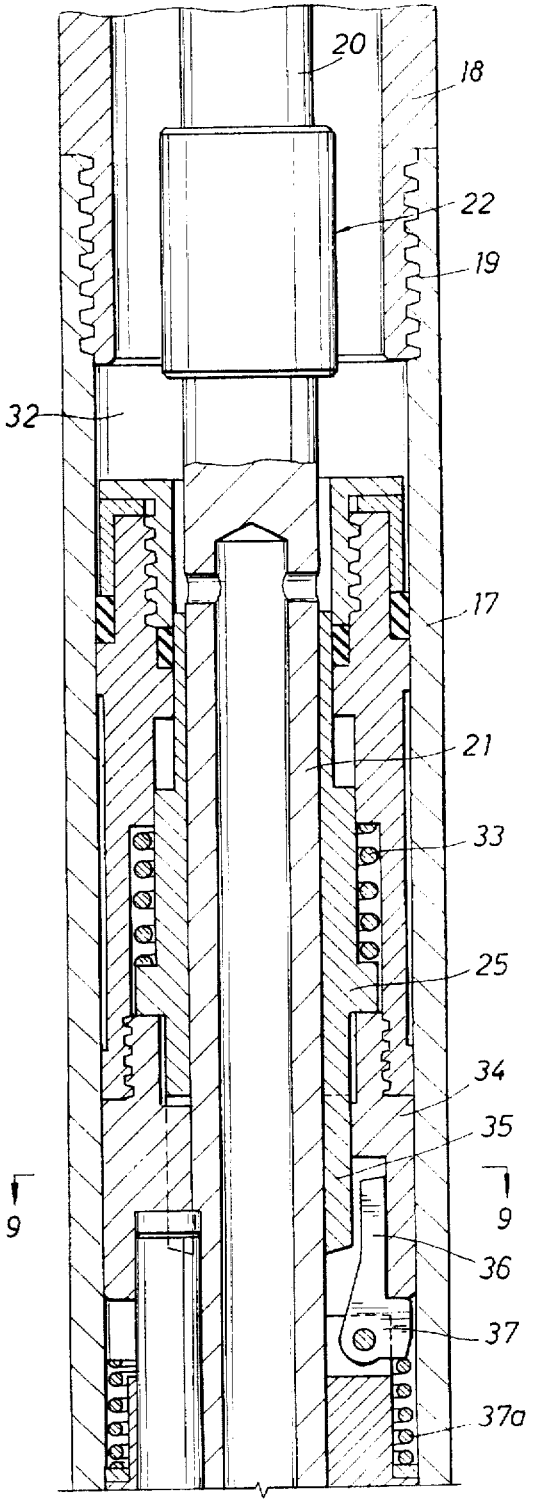

The upper end of torque tube 21 is surrounded by piston 25. Internal piston seal **26*b* and external piston seal 27*b* are held in sealing engagement by internal packing gland 26*a* and external packing gland 27*a*. Threads 28 are available to adjust the compression in the seal rings. Torque tube 21 has a longitudinal opening 30 that extends all the way from a point just below its upper end as shown in FIG. 2A through the lower end of the torque tube. Connecting opening 30 to the outside of the torque tube are a plurality of six lateral ports 31, two of which are shown in the drawing. When the fluid pressure in annulus 32 is increased sufficiently to compress spring 33 and move piston 25 downwardly to the position shown in FIG. 3A, ports 31 will be open and drilling mud can flow through the ports into central opening 30** and through the rotator to the mud motor connected at the lower end of the rotator.

Figure 6:
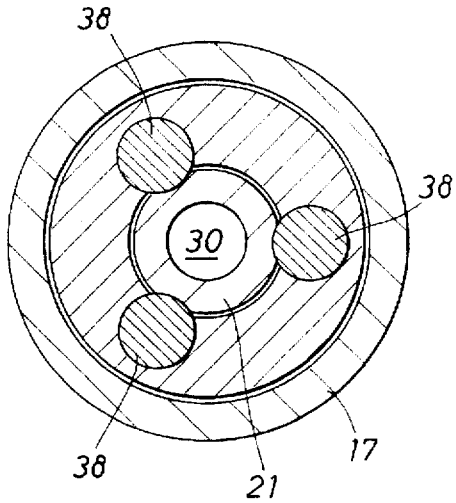
FIG. 6 is a section taken along line 6—6 of FIG. 2B.

As the piston moves downwardly, lower piston end connection 34 moves downwardly under with the piston as does latch extension ring 35. The lower end of the extension ring engages arm 36 on latch 37 and causes it to pivot to the position shown in FIG. 3A releasing the piston for further downward movement. Also moving downwardly with the piston are three actuating cam shafts 38. Cam shafts 38 and latches 37 are shown in FIGS. 6 and 8. In FIG. 9, the relationship of latch extension ring 34 and latch arm 36 is shown.

Figure 3B:
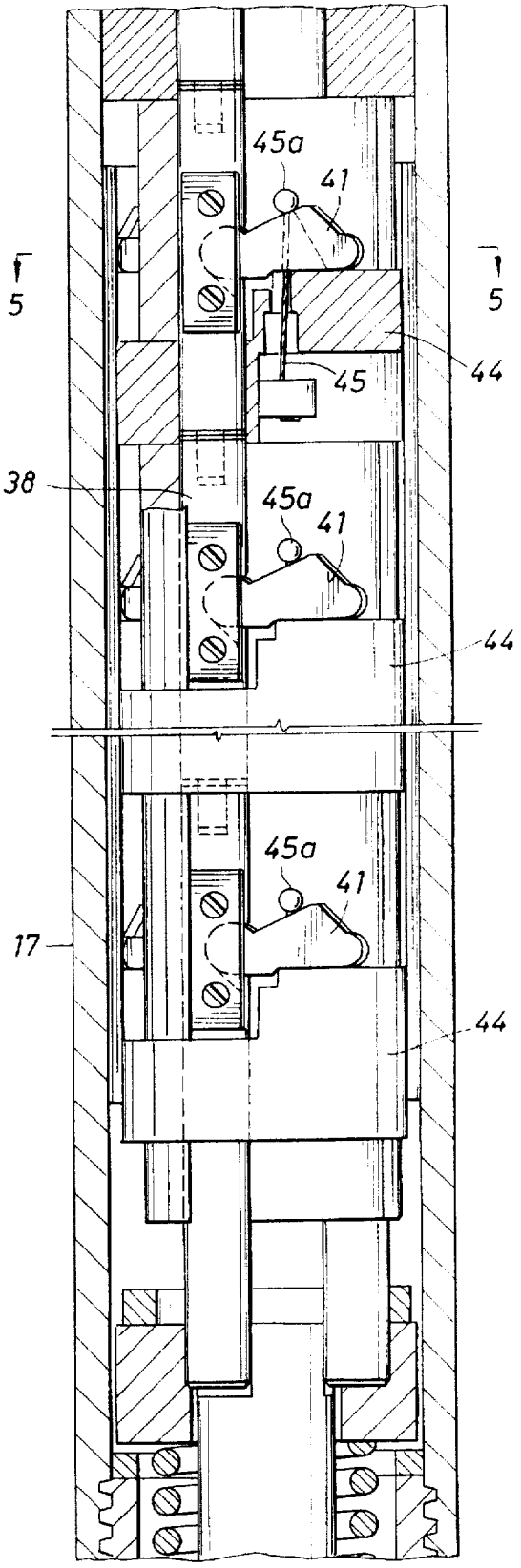
Figure 4:
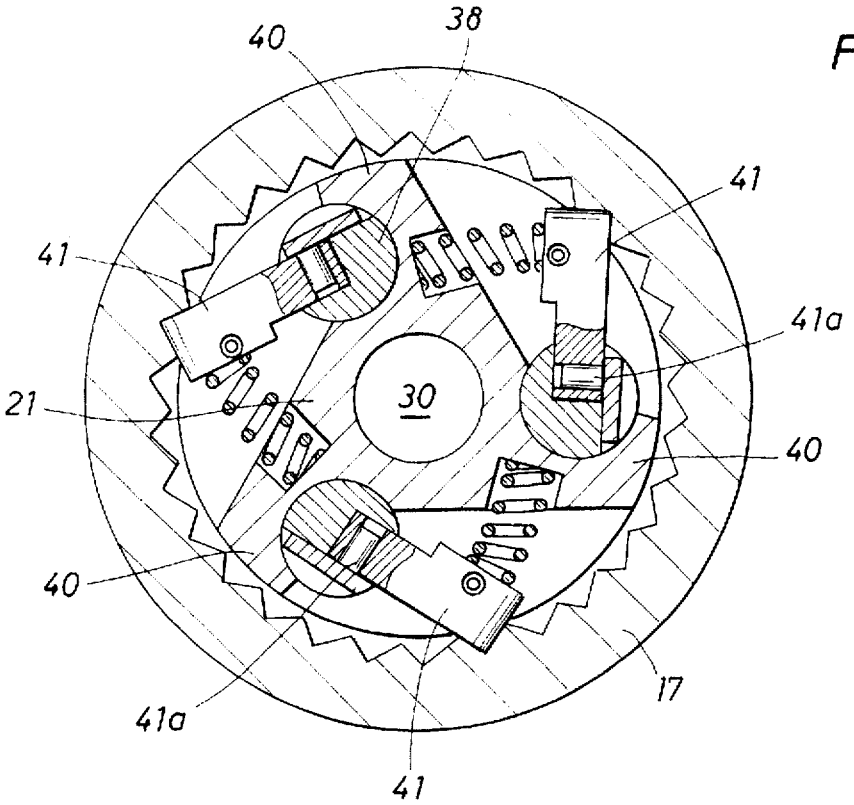
FIG. 4 is a cross-sectional view taken along line 4—4 of FIG. 2B showing the position of the cam arms when drilling mud is not being circulated through the rotator.
Figure 5:
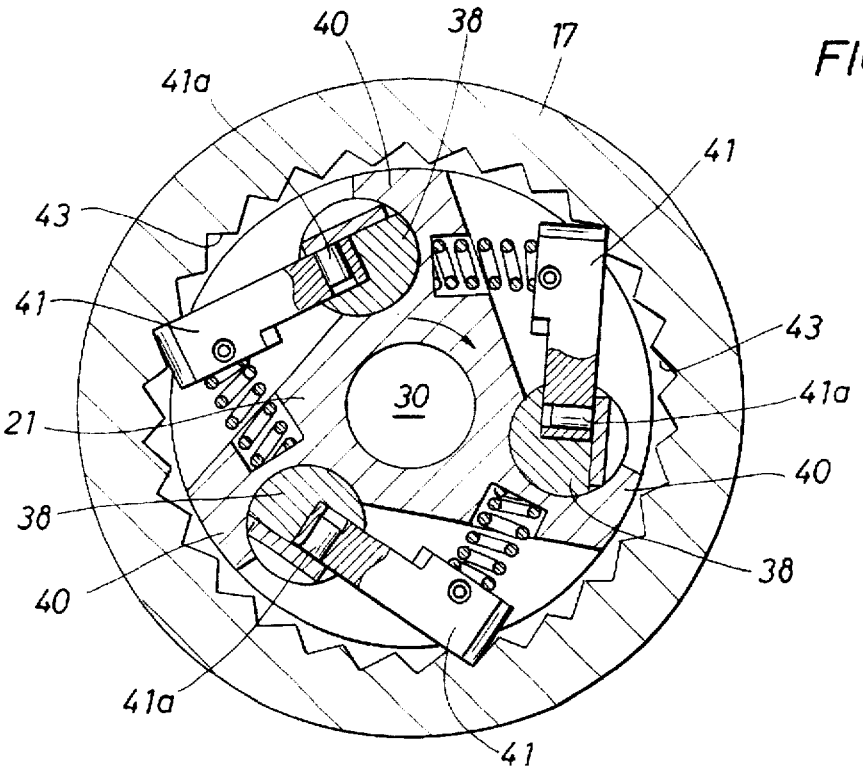
FIG. 5 is a cross-sectional view taken along line 5—5 of FIG. 3B showing the position of the cam arms after the rotator has rotated the steering tool and mud motor an incremental distance and drilling mud is being circulated through the rotator through opening 30.

FIGS. 4 and 5 are cross-sections through one of the cam sections of the tool showing one set of three cam arms 41. In the embodiment shown, three sets of cam arms are shown. Throughout each section, the cross-sectional shape of torque tube 21 is especially arranged to provide three lever arms 40 against which cam arms 41 can exert the force required to rotate the torque tube clockwise as shown in FIG. 5. This rotation occurs each time piston 25 is moved downwardly by mud pressure in the tubing. Cam arms 41 are carried by cam shafts 38. Each of the cam arms are pivotally connected to one of the cam shafts by pins 41*a*. The other end of each cam arm engages a tooth on internal ratchet 43. As shown in FIG. 2B, when piston 25 is in its upward position closing ports 31, the cam arms are inclined downwardly in engagement with the upper surface of cam axial walls 44. The cam arms are held in that position by elastic cords 45 that are anchored at one end to the cam axial walls and while the other ends extend through openings through the cam arms and are attached to balls 45*a* that anchor the elastic cords to the cam arms. As piston 25 moves downwardly, moving cam rods 38 downwardly, cam arms 41 are pivoted to positions generally perpendicular to the longitudinal axis of the tool, as shown in FIG. 3B. Since the perpendicular distance to the ratchet from the cam shafts is less than the inclined distance, the movement causes internal ratchet 43 to rotate one tooth or in this case 24°. One of the advantages of this arrangement is that the force component exerted on the torque tube by the cam arms is substantial and more than adequate to rotate the mud motor even if the bit is in engagement with the bottom of the hole and to also rotate the internal sensors of the steering tool.

Figure 7:
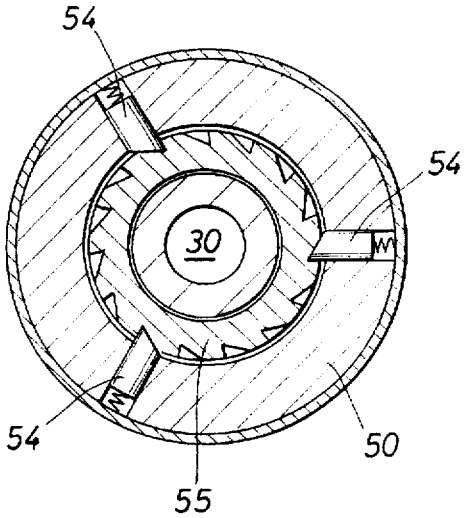
FIG. 7 is a cross-sectional view taken along line 7—7 of FIG. 2C.

In operation, then, the torque tube of the rotator will rotate the steering tool sensors and the mud motor the same incremental distance each time piston 25 is moved downwardly using the pressure of the drilling fluid in the tubing. The torque tube rotates the mud motor by rotating mechanical lock assembly located at the lower end of the rotator and is shown in FIG. 2C. It includes mechanical lock housing 50 that is attached to mud motor housing 23 by threaded double pin connection 24. Mechanical lock housing is supported for rotation on thrust bearings 52. The housing is supported for rotation relative to the torque tube by journal bearings 53. Spring loaded pawls 54 engage sprocket 55 as shown in FIG. 7. The teeth of the sprocket and the ends of the pawl are designed to allow rotation in a clockwise direction as shown in FIG. 7 and to prevent rotation in the counterclockwise direction. The clockwise direction is the direction in which the tool is designed to rotate the mud motor and the steering tool relative to the tubing string.

From the foregoing it will be seen that this invention is one well adapted to attain all of the ends and objects hereinabove set forth, together with other advantages which are obvious and which are inherent to the method and apparatus.

It will be understood that certain features and subcombinations are of utility and may be employed without reference to other features and subcombinations. This is contemplated by and is within the scope of the claims.

Because many possible embodiments may be made of the invention without departing from the scope thereof, it is to be understood that all matter herein set forth or shown in the accompanying drawings is to be interpreted as illustrative and not in a limiting sense.

What is claimed is:

1. A fluid powered rotator for connecting in a pipe string located in a well bore intermediate the ends of the pipe string to divide the pipe string into an upper portion between the rotation and the surface and a lower portion extending between the rotator and the bottom of the well bore to be rotated relative to the upper portion by the rotator by raising the pressure of the fluid in the pipe string, said rotator comprising a housing connected to the pipe string above the rotator, a torque tube located in and extending along the longitudinal axis of the housing said torque tube having an upper end and a lower end for connecting to a pipe string below the rotator, said torque tube having a central passageway open at the lower end of the torque tube and closed adjacent the upper end of the torque tube, lateral openings in the upper end of the torque tube through which drilling fluid can flow into the central passageway and into the pipe string connected to the lower end of the rotator, bearings supporting the torque tube for rotation relative to the housing, an annular piston surrounding the upper end of the torque tube and movable by pressure in the pipe string from a first position closing the lateral openings to the central passageway to a second position opening the lateral openings to allow drilling fluid to flow into the lateral openings of the torque tube and through the passageway through the torque tube to the portion of the pipe string below the rotator, resilient means urging the piston toward the first position, a plurality of longitudinally extending grooves forming teeth on the inside of the housing below the rotator, a cam shaft extending below the piston for downward movement with the piston, a cam arm pivotally connected to the cam shaft and extending laterally from the cam shaft at an angle with its outer end engaging one of the teeth on the inside of the housing so that downward movement of the piston rotates the cam arm toward a position perpendicular to the cam shaft to rotate the torque tube and the portion of the pipe string below the rotator an incremental distance.

2. The rotator of claim 1 further provided with a plurality of axially spaced cam axial walls having surfaces for supporting the ends of the cam arms and to cause the cam arms to pivot to a position more perpendicular to the longitudinal axis of the rotator.

3. A method of actuating a rotator to rotate a steering tool an incremental distance relative to a supporting pipe string comprising the steps of increasing the pressure in the drilling fluid to move a torque tube downward to allow drilling fluid to flow through the torque tube to the mud motor and to move an inclined cam arm to a position generally perpendicular to the longitudinal axis of the rotation to force the torque tube and the mud motor to rotate an incremental distance.

4. A bottom hole assembly for use with coil tubing for drilling, comprising a mud motor having a housing that is bent section at its lower end, an output shaft extending through the bent section of the housing, a drill bit connected to the output shaft to be rotated as drilling mud is pumped through the mud motor, a rotator torque tube is connected to the housing of the mud motor to allow the rotator to rotate the housing of the mud motor to change the orientation of the bent section of the housing as required to drill in the desired direction, a steering tool having a housing connected to the housing of the rotator and a central mandrel that is connected to the torque tube of the rotator so that the sensors of the steering tool will be rotated the same incremental distance as the torque tube of the rotator and the bent housing so that the orientation of the mandrel in the steering tool and the bent housing can be monitored at the surface.

5. In a bottom hole assembly for drilling a non-vertical, directional borehole including a mud motor for rotating a drilling bit and a steering tool for transmitting information to the surface as to the direction and angle the borehole is being drilled, the mud motor having an output shaft connected to a drill bit and a bent housing to cause the bit to drill an arcuate well bore, the improvement comprising connecting a rotator in the bottom hole assembly between the mud motor and the steering tool, the rotator including a housing, a piston in the upper end of the housing torque tube mounted in the housing with its upper end connected to the output shaft of the steering tool and the lower end connected to the housing of the mud motor, a piston mounted on the torque tube and movable downwardly by the pressure of the drilling fluid being pumped through the rotator and the mud motor, a plurality of parallel teeth extending longitudinally along the inside wall of the rotator housing, cam shafts extending longitudinally parallel to the torque tube, a plurality of cam arms spaced along pivotally mounted on the cam shaft, a plurality of cam support surfaces holding the ends of the cam arms extending downwardly at an angle in engagement with the teeth and to rotate the cam arms to a horizontal position as the cam shafts are moved downwardly by the pressure of the drilling fluid on the piston to move the cam arms to a position perpendicular to the longitudinal axis of the housing and rotate the torque tube to steering tool instruments, and the mud motor housing a predetermined distance.

6. A method of rotating a mud motor and the sensors of a steering tool together to adjust the direction a drill bit rotated by the mud motor drills a well bore, the method comprising the steps of pumping drilling fluid through the mud motor to rotate a drill bit and drill a well bore, a rotator connected to the mud motor for rotation of the mud motor and the sensors of a steering tool relative to the rotation, increasing the volume of drilling mud flowing through the rotators to move cam arms from an inclined position to a position generally transverse the longitudinal axis of the rotator to rotate the housing of the mud motor and the sensors of the steering tool an incremental distance to adjust the direction the bit is drilling the well bore, reducing the pressure of the drilling fluid and repeating the steps of increasing and decreasing the pressure of the drilling fluid as required to adjust the direction the well bore is drilled.

7. A method of changing the direction a drill bit rotated by a bent sub and a mud motor drills a well bore comprising the steps of stopping the flow of drilling fluid through a rotator above the mud motor, said rotator having an output shaft connected to the bent sub, raising the pressure in the drilling mud sufficiently to cause a cam arm in the rotator to rotate the mud motor an incremental distance to reposition the bent sub and the drill bit to change the direction the bit drills a well bore, and repeating the step of raising and lowering the pressure of the drilling fluid as required to move the bent sub and the bit into position to drill a well bore in the desired direction.

* * * * *